US012460503B2

(12) United States Patent
Garcia et al.

(10) Patent No.: US 12,460,503 B2
(45) Date of Patent: Nov. 4, 2025

(54) STRAIN ABSORBING DOWNHOLE PACKER

(71) Applicant: TAM INTERNATIONAL, INC., Houston, TX (US)

(72) Inventors: Luis A. Garcia, Kingwood, TX (US); Tim Davis, Spring, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 0 days.

(21) Appl. No.: 18/748,695

(22) Filed: Jun. 20, 2024

(65) Prior Publication Data

US 2024/0426189 A1 Dec. 26, 2024

Related U.S. Application Data

(60) Provisional application No. 63/522,928, filed on Jun. 23, 2023.

(51) Int. Cl.
*E21B 33/12* (2006.01)
*E21B 23/06* (2006.01)

(52) U.S. Cl.
CPC ..... *E21B 33/1208* (2013.01); *E21B 23/06* (2013.01)

(58) Field of Classification Search
CPC .. E21B 33/1208; E21B 23/06; E21B 33/1216; E21B 33/12
See application file for complete search history.

(56) References Cited

U.S. PATENT DOCUMENTS 7,963,321 B2 * 6/2011 Kutac ..... E21B 33/1216 166/187
2009/0173505 A1 * 7/2009 Patel ..... E21B 33/1208 166/385
2010/0276137 A1 * 11/2010 Nutley ..... E21B 33/1216 166/185
2011/0056706 A1 * 3/2011 Brooks ..... E21B 33/1208 166/134
2013/0001881 A1 * 1/2013 McRobb ..... E21B 33/1208 277/336
2015/0027704 A1 * 1/2015 Andersen ..... E21B 33/12 166/180
2016/0177660 A1 * 6/2016 Cuffe ..... E21B 33/12 166/387
2023/0184053 A1 * 6/2023 Coronado ..... E21B 33/128 166/387

* cited by examiner

*Primary Examiner* — Steven A Macdonald
(74) *Attorney, Agent, or Firm* — Ewing & Jones, PLLC

(57) ABSTRACT

A method comprising a) providing a packer comprising a tubular mandrel, a swellable elastomeric body supported on the mandrel, and first and second end caps secured to the mandrel, each end cap having an inner bore therethrough and being positioned such that a first end of each end cap abuts an end of the swellable elastomeric body, wherein the first end of at least one end cap includes a strain absorbing undercut formed in the inner bore thereof; b) positioning the packer within a wellbore; c) providing a swelling fluid into the wellbore; d) forming a fluid seal against the wellbore with the swellable elastomeric body; and e) extruding the swellable elastomeric body into the undercut.

18 Claims, 6 Drawing Sheets

STRAIN ABSORBING DOWNHOLE PACKER

CROSS-REFERENCE TO RELATED APPLICATIONS

This application is a nonprovisional application which claims priority from U.S. provisional application No. 63/522,928, filed Jun. 23, 2023, which is incorporated by reference herein in its entirety.

TECHNICAL FIELD/FIELD OF THE DISCLOSURE

The present disclosure relates generally to downhole isolation tools, and specifically to swellable packers.

BACKGROUND OF THE DISCLOSURE

Swellable packers are isolation devices used in a downhole wellbore to seal the inside of the wellbore or a downhole tubular that rely on elastomers to expand and form an annular seal when immersed in certain wellbore fluids. Typically, elastomers used in swellable packers are either oil- or water-sensitive. Various types of swellable packers have been devised, including packers that are fixed to the outside diameter of a tubular and the elastomer formed by wrapped layers, and designs wherein the swellable packer is slipped over the tubular and locked in place.

SUMMARY

In some embodiments, a packer may comprise a tubular mandrel, a swellable elastomeric body positioned about the mandrel, and a first end cap. The first end cap may be generally annular and may have a first inner bore. The mandrel may extend through the first inner bore and the first end cap may be coupled to the mandrel. The first end cap may abut a first end of the swellable elastomeric body at a first end of the first end cap. The first end of the first end cap may include a first strain absorbing undercut formed in the inner bore thereof.

The packer may further comprise a second end cap. The second end cap may be generally annular and may have a second inner bore. The mandrel may extend through the second inner bore and the second end cap may be coupled to the mandrel. The second end cap may abut a second end of the swellable elastomeric body at a first end of the second end cap. The first end of the second end cap may include a second strain absorbing undercut formed in the inner bore thereof.

The packer may further include an adhesive layer between the swellable elastomeric body and at least one of the first and second end caps. The at least one strain absorbing undercut may be annular or may define a plurality of arcuate pockets. In some embodiments, each undercut may have an open end and bottom surface. At least one of the first and second end caps may include a bevel or chamfer at its open end. The strain absorbing undercut may contain a mesh or other mechanism that mitigates extrusion of the swellable elastomeric body into an annulus between the end cap and the mandrel.

The packer may further comprise an anchor screw positioned to couple the first end cap to the mandrel.

The swellable elastomeric body may be formed by wrapped layers and may be at least partially bonded to the mandrel. The swellable elastomeric body may swell in response to contact with a water-based or oil-based swelling fluid.

In some embodiments, a method for sealing a well may comprise a) providing a packer comprising: a1) a tubular mandrel, a2) a swellable elastomeric body supported on the mandrel, and a3) first and second end caps secured to the mandrel, wherein each end cap has an inner bore therethrough and a strain absorbing undercut formed at a first end of the inner bore and wherein each end cap is positioned such that a first end of each end cap abuts an end of the swellable elastomeric body; b) positioning the packer within a wellbore or casing; c) providing a swelling fluid into the wellbore or casing; d) forming a fluid seal against the wellbore or casing with the swellable elastomeric body; and e) allowing the swellable elastomeric body to swell into the undercut.

The packer may include an adhesive between the swellable elastomeric body and the first end of at least one end cap. The engagement of the elastomeric body with the adhesive may delay step e) relative to step d).

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
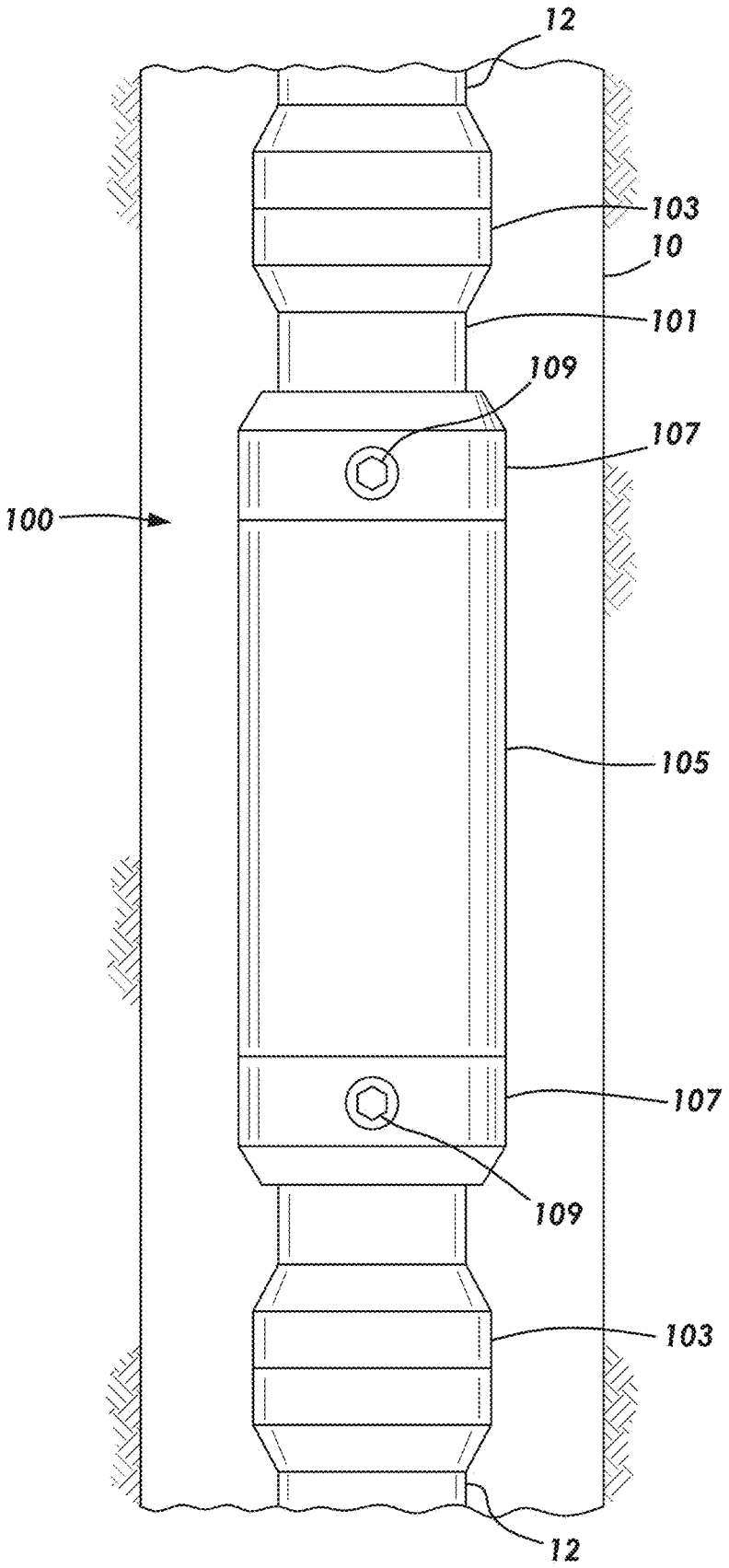
FIG. 1 depicts a wellbore including a packer consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 illustrates one embodiment of packer 100 for positioning downhole in a well to seal with either the interior surface of a borehole or an interior surface of a downhole tubular. During operation, packer 100 may be generally aligned with the central bore of wellbore 10 or the central bore of the tubular in the well when packer 100 may be lowered to the desired depth in the well. Mandrel 101 may include threaded connections 103 positioned to allow packer 100 to be included as a part of a downhole string 12.

Figure 2:
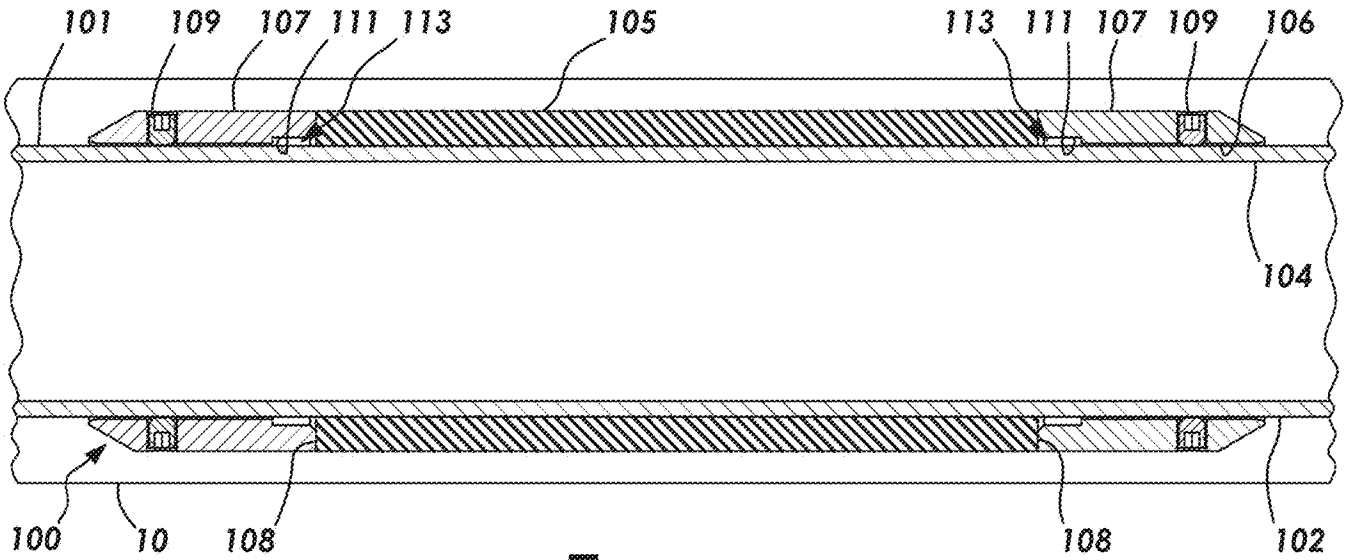
FIG. 2 is a cross section of a packer consistent with at least one embodiment of the present disclosure.

In some embodiments, as shown in FIG. 2, packer 100 may include a mandrel 101. Mandrel 101 may be tubular, having an outer surface 102 and an inner (bore) surface 104. Packer 100 may include a swellable elastomeric body 105, which may be positioned on the outer surface 102 of mandrel 101. In certain embodiments and as further described herein below, swellable elastomeric body 105 may be fixed to outer surface 102 and formed by wrapped layers. In other embodiments, swellable elastomeric body 105 may be molded directly onto outer surface 102. In some embodiments, swellable elastomeric body 105 may be bonded to mandrel 101 along the full length of swellable elastomeric body 105. In other embodiments, swellable elastomeric body 105 may be bonded to mandrel 101 along only a portion or portions of swellable elastomeric body 105. For example, in some embodiments, only a central portion of swellable elastomeric body 105 may be bonded to mandrel 101, while the rest of swellable elastomeric body 105 is positioned about mandrel 101 but is not bonded thereto. As another example, in some embodiments, one end of swellable elastomeric body 105 may be bonded to mandrel 101, while the rest of swellable elastomeric body 105 is positioned about mandrel 101 but is not bonded thereto.

Swellable elastomeric body 105 may be formed from an elastomeric material that swells in response to the absorption of a swelling fluid, generally an oil- or water-based fluid. The composition of the swelling fluid needed to activate packer 100 may be selected with consideration of the intended use of the packer. For example, a packer designed to pack off an area of a well at once may be either oil- or water-based and activated by a fluid pumped downhole. Alternatively, a delayed-use packer may be positioned in a well for long periods of time during, for example, hydrocarbon production. A swellable elastomeric body 105 which swells in response to an oil-based fluid would prematurely pack off the annulus. A swellable elastomeric body 105 which swells in response to water would therefore be used. Furthermore, one having ordinary skill in the art would understand that this selection can allow packer 100 to automatically activate in response to environmental phenomena. Such a packer could be used, for example, to provide automatic zonal isolation in response to production of water in an actively producing well.

In some embodiments, packer 100 may include an end cap 107 positioned at one or both ends of swellable elastomeric body 105. Each end cap 107 may be generally annular and may include an inner bore 106. Each end cap 107 may attach to outer surface 102 at an end of swellable elastomeric body 105. In some embodiments, at least one end cap 107 abuts an end of swellable elastomeric body 105 at an interface 108. An adhesive layer may be included at interface 108 so as to bond swellable elastomeric body 105 to end cap 107. In some embodiments, end caps 107 may be held in place by anchor screws 109 that engage mandrel 101 once end caps 107 are positioned as desired.

In some embodiments, as shown in FIGS. 2-5, each end cap 107 may include strain absorbing undercut 111. Strain absorbing undercut 111 may be an annular space formed on the inner bore of end cap 107 at the end of end cap 107 that abuts swellable elastomeric body 105 when packer 100 is assembled. Strain absorbing undercut 111 may be formed, for example and without limitation, by turning, milling, or boring of the end of end cap 107. When assembled and in the run-in configuration shown in FIGS. 2, 3, strain absorbing undercut 111 and mandrel 101 may together define annular strain mitigation pocket 113.

Figure 3:
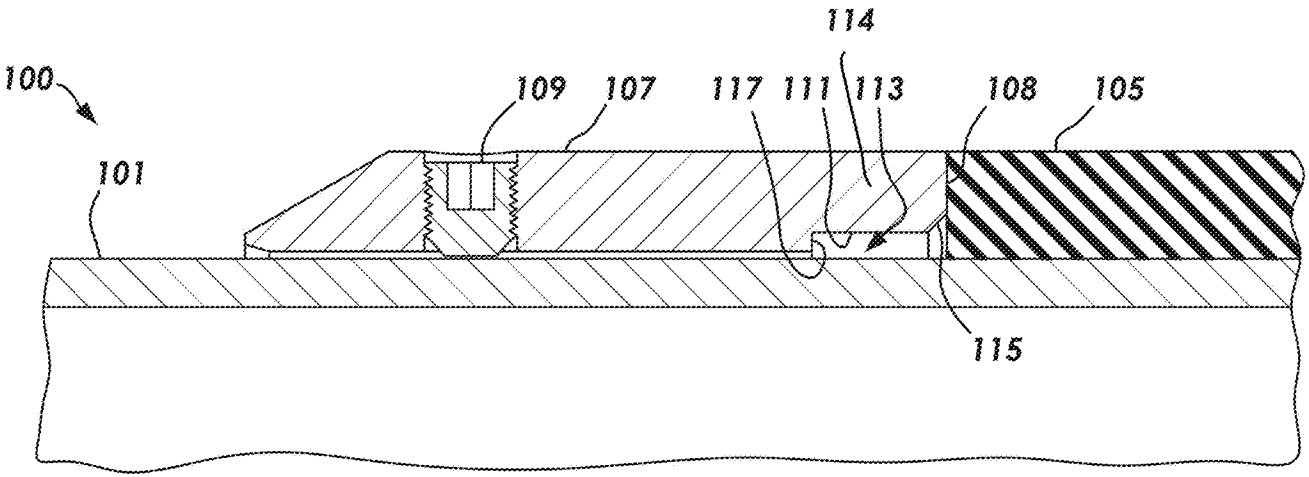
FIG. 3 is an enlarged cross section of a portion of the packer of FIG. 2
Figure 7:
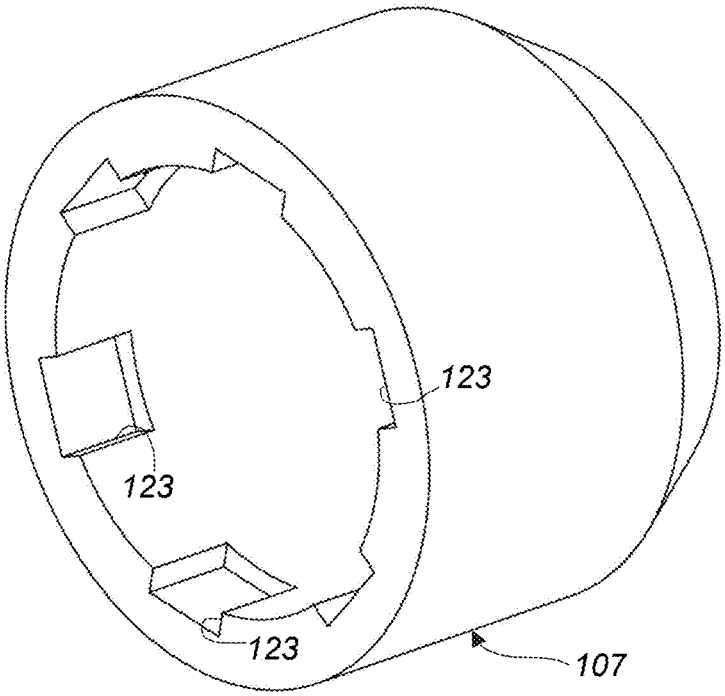
FIG. 7 is an isometric view of a component of an alternative embodiment of the packer shown in FIG. 2.
Figure 8:
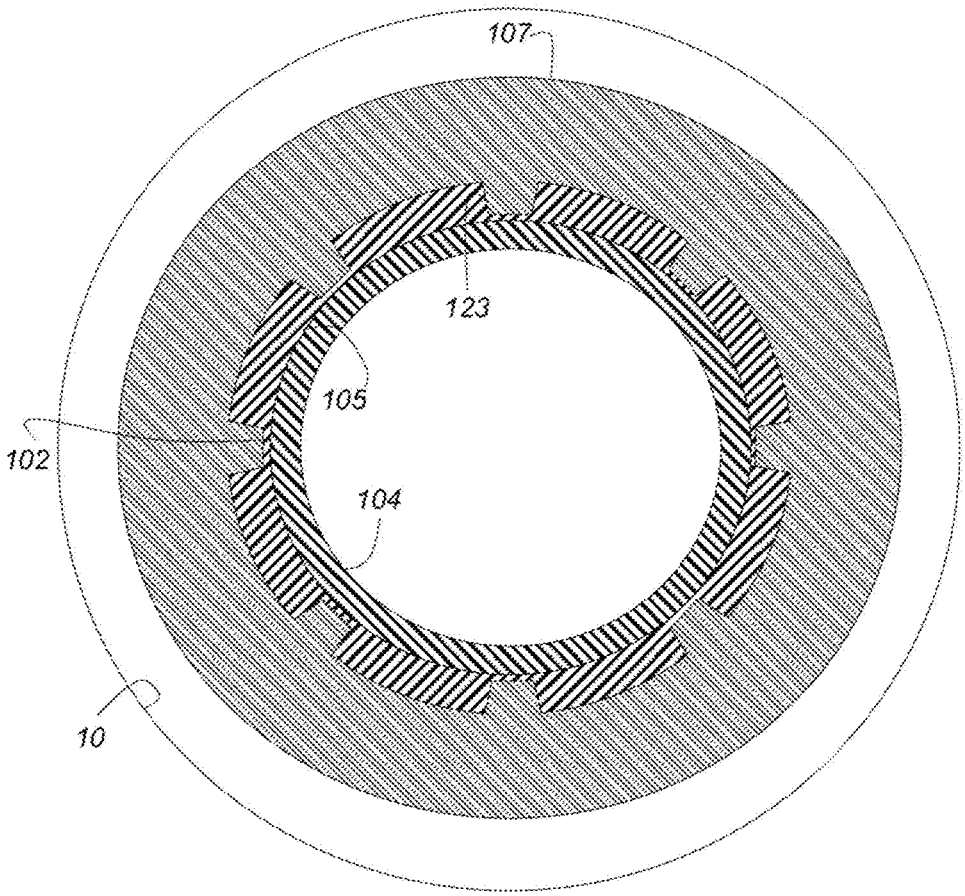
FIG. 8 is a cross-section taken along lines 8-8 of FIG. 4.

In some embodiments, strain absorbing undercut 111 is annular and may have a substantially cylindrical side wall 114 and a bottom surface 117 (FIG. 3). In some embodiments, the open end of strain absorbing undercut 111 may be contoured or rounded or may include additional features such as chamfer or bevel 115. In some embodiments, strain absorbing undercut 111 is not annular; in these embodiments, strain absorbing undercut 111 may define a plurality of arcuate pockets 123 (FIGS. 7 and 8) and extrusion of swellable elastomeric body 105 into the arcuate pockets 123 may help prevent rotation of swellable elastomeric body 105 relative to end caps 107 and mandrel 101.

Figure 4:
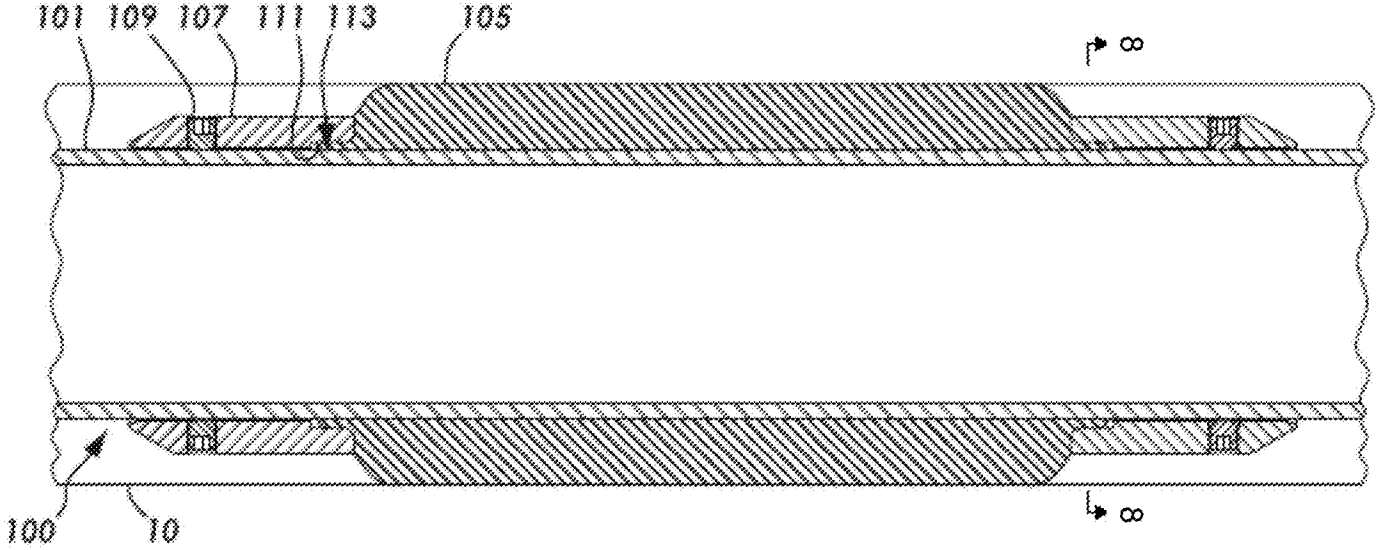
FIG. 4 is a cross section view of the packer of FIG. 2 in an expanded state.
Figure 5:
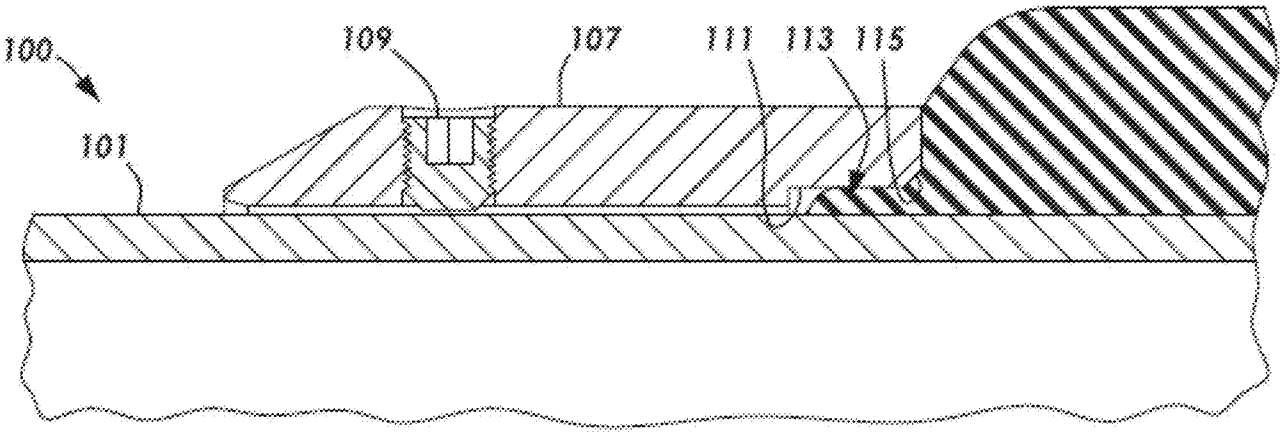
FIG. 5 an enlarged cross section of a portion of the packer of FIG. 3.

In operation, once packer 100 is positioned within the wellbore at a desired position, swelling fluid may be provided into the wellbore and may be absorbed by swellable elastomeric body 105. As swellable elastomeric body 105 absorbs the swelling fluid, swellable elastomeric body 105 may expand radially as shown in FIGS. 4, 5 to contact the wellbore and provide fluid isolation as discussed above. However, because swellable elastomeric body 105 expands in all directions, swellable elastomeric body 105 also expands longitudinally. Strain absorbing undercut 111 allows swellable elastomeric body 105 to expand at least partially into strain mitigation pocket 113. This ability to expand may reduce the overall strain placed on swellable elastomeric body 105 while expanding as opposed to a packer in which the end caps form a flat barrier. Additionally, the expansion of swellable elastomeric body into strain mitigation pocket 113 may, for example and without limitation, further anchor swellable elastomeric body 105 to end cap 107 and mandrel 101 and, because swellable elastomeric body 105 is compressed against mandrel 101, may increase fluid sealing between swellable elastomeric body 105 and mandrel 101, thus reducing the ability for fluid to pass between body 105 and mandrel 101. In addition, when swellable elastomeric body 105 absorbs fluids, it applies load against the casing or wellbore. That load has the potential to damage the casing or wellbore. Strain mitigation pocket 113 may alleviate that load. The ability of the body to extend into the pocket may reduce the amount of load on the casing or wellbore. In embodiments in which adhesive is present at interface 108, the adhesive may prevent or slow the contact of swelling fluids with the end of swellable elastomeric body 105, thereby delaying the longitudinal swelling of swellable elastomeric body 105 into strain mitigation pocket 113 relative to the radial swelling of swellable elastomeric body 105 outward toward the wellbore or casing.

Figure 6:
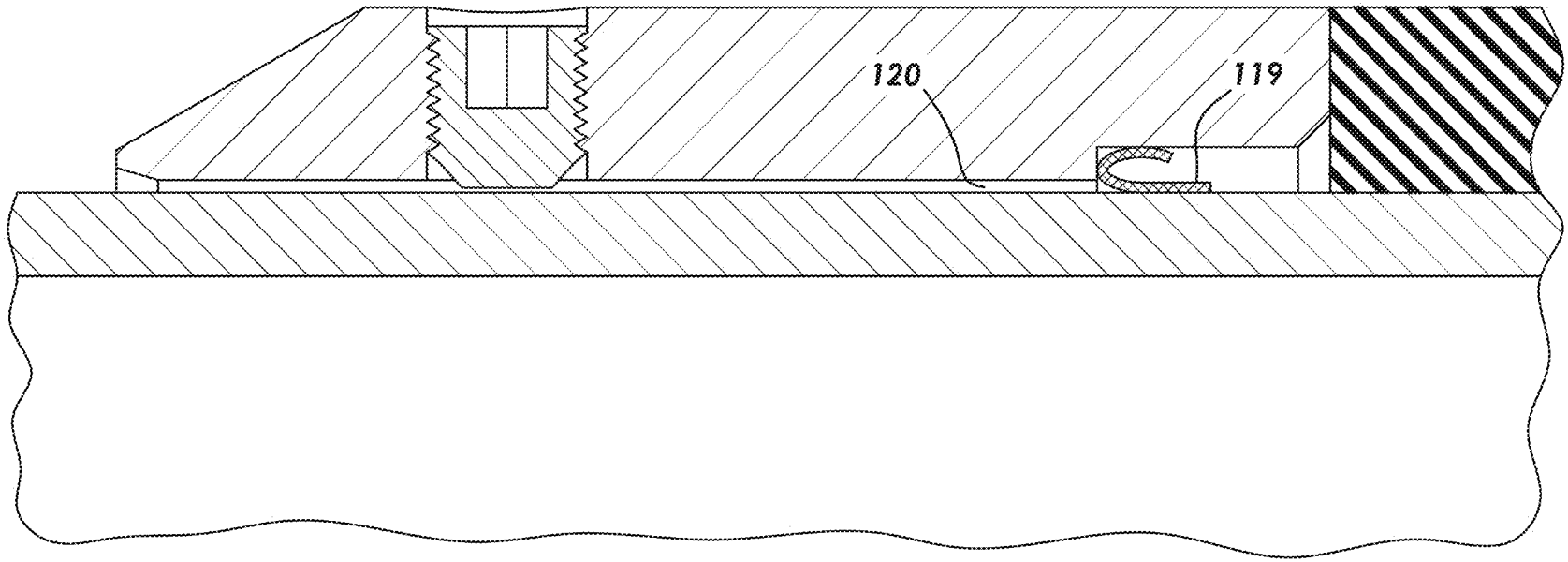
FIG. 6 is an enlarged view of a portion of an alternative embodiment of the packer shown in FIG. 2.

Referring briefly to FIG. 6, in some embodiments, strain mitigation pocket 113 may include a mesh, membrane, or other mechanism 119 that mitigates extrusion of swellable elastomeric body 105 into the annulus 120 between end cap 107 and mandrel 101. By way of example only, mechanism 119 may comprise wire mesh.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A packer comprising:

a tubular mandrel having a longitudinal axis;

a swellable elastomeric body positioned about the mandrel; and a first end cap, the first end cap being generally annular and having a first inner bore, wherein the mandrel extends through the first inner bore and the first end cap is coupled to the mandrel, wherein the first end cap abuts a first end of the swellable elastomeric body at a first end of the first end cap, and wherein the first end of the first end cap includes a first strain absorbing undercut formed in the inner bore thereof, the first strain absorbing undercut being configured such that the swellable elastomeric body can expand parallel to the longitudinal axis into the first strain absorbing undercut.

2. The packer of claim 1, further comprising:

a second end cap, the second end cap being generally annular and having a second inner bore, wherein the mandrel extends through the second inner bore and the second end cap is coupled to the mandrel, wherein the second end cap abuts a second end of the swellable elastomeric body at a first end of the second end cap, and wherein first end of the second end cap includes a second strain absorbing undercut formed in the inner bore thereof.

3. The packer of claim 1, further including an adhesive layer between the swellable elastomeric body and at least one of the first and second end caps.

4. The packer of claim 1 wherein at least one strain absorbing undercut is annular.

5. The packer of claim 1 wherein at least one strain absorbing undercut defines a plurality of arcuate pockets.

6. The packer of claim 1 wherein each undercut has an open end and bottom surface and wherein at least one of the first and second end caps includes a bevel or chamfer at its open end.

7. The packer of claim 1, further comprising an anchor screw positioned to couple the first end cap to the mandrel.

8. The packer of claim 1 wherein the swellable elastomeric body is formed by wrapped layers.

9. The packer of claim 1 wherein the swellable elastomeric body is at least partially bonded to the mandrel.

10. The packer of claim 1 wherein the swellable elastomeric body swells in response to contact with a water-based or oil-based swelling fluid.

11. A method comprising:

a) providing a packer comprising:

a1) a tubular mandrel having a longitudinal axis;

a2) a swellable elastomeric body supported on the mandrel; and a3) first and second end caps secured to the mandrel, each end cap having an inner bore therethrough and positioned such that a first end of each end cap abuts an end of the swellable elastomeric body, wherein the first end of at least one end cap includes a strain absorbing undercut formed in the inner bore thereof, the strain absorbing undercut being configured such that the swellable elastomeric body can expand parallel to the longitudinal axis into the strain absorbing undercut;

b) positioning the packer within a wellbore or casing;

c) providing a swelling fluid into the wellbore or casing;

d) forming a fluid seal against the wellbore or casing with the swellable elastomeric body; and e) allowing the swellable elastomeric body to swell longitudinally into the undercut.

12. The method of claim 11 wherein the packer includes an adhesive between the swellable elastomeric body and the first end of at least one end cap and wherein engagement of the elastomeric body with the adhesive delays step e) relative to step d).

13. The method of claim 11 wherein the strain absorbing undercut contains a mesh.

14. The method of claim 11 wherein the strain absorbing undercut is annular.

15. The method of claim 11 wherein the strain absorbing undercut defines a plurality of arcuate pockets.

16. A method comprising:

a) providing a packer comprising:

a1) a tubular mandrel;

a2) a swellable elastomeric body supported on the mandrel; and a3) first and second end caps secured to the mandrel, each end cap having an inner bore therethrough and positioned such that a first end of each end cap abuts an end of the swellable elastomeric body, wherein the first end of at least one end cap includes a strain absorbing undercut formed in the inner bore thereof, and wherein the strain absorbing undercut contains a mesh;

b) positioning the packer within a wellbore or casing;

c) providing a swelling fluid into the wellbore or casing;

d) forming a fluid seal against the wellbore or casing with the swellable elastomeric body; and e) allowing the swellable elastomeric body to swell longitudinally into the undercut.

17. A method comprising:

a) providing a packer comprising:

a1) a tubular mandrel;

a2) a swellable elastomeric body supported on the mandrel; and a3) first and second end caps secured to the mandrel, each end cap having an inner bore therethrough and positioned such that a first end of each end cap abuts an end of the swellable elastomeric body, wherein the first end of at least one end cap includes a strain absorbing undercut formed in the inner bore thereof, and wherein the strain absorbing undercut defines a plurality of arcuate pockets;

b) positioning the packer within a wellbore or casing;

c) providing a swelling fluid into the wellbore or casing;

d) forming a fluid seal against the wellbore or casing with the swellable elastomeric body; and e) allowing the swellable elastomeric body to swell into the undercut.

18. A packer comprising:

a tubular mandrel;

a swellable elastomeric body positioned about the mandrel; and a first end cap, the first end cap being generally annular and having a first inner bore, wherein the mandrel extends through the first inner bore and the first end cap is coupled to the mandrel, wherein the first end cap abuts a first end of the swellable elastomeric body at a first end of the first end cap, and wherein the first end of the first end cap includes a first strain absorbing undercut formed in the inner bore thereof;

wherein at least one strain absorbing undercut defines a plurality of arcuate pockets.

* * * * *